United States Patent [19]

Sund

[11] 4,064,834

[45] Dec. 27, 1977

[54] APPARATUS FOR SENSING THE CONCENTRATION OF TONER IN A DEVELOPER MIX

[75] Inventor: Joseph T. Sund, Los Angeles, Calif.

[73] Assignee: A. B. Dick Company, Chicago, Ill.

[21] Appl. No.: 743,179

[22] Filed: Nov. 19, 1976

[51] Int. Cl.[2] ..... G03G 15/06

[52] U.S. Cl. ..... 118/646; 118/7; 118/9; 222/DIG. 1; 355/3 DD

[58] Field of Search ..... 118/7, 9, 646, 655-658; 355/3 DD; 222/DIG. 1; 427/17, 18, 20

[56] References Cited

U.S. PATENT DOCUMENTS

| | | | |
|---|---|---|---|
| 3,409,901 | 11/1968 | Dost et al. | 118/646 X |
| 3,536,042 | 10/1970 | Weiler | 118/646 |
| 3,821,938 | 7/1974 | Bacon et al. | 118/7 |
| 3,910,459 | 10/1975 | Bock et al. | 118/646 X |
| 3,928,764 | 12/1975 | Bock et al. | 118/646 X |
| 3,932,034 | 1/1976 | Takahashi | 118/646 X |
| 3,943,887 | 3/1976 | Smith | 118/646 |
| 3,999,119 | 12/1976 | Bares | 118/646 X |

OTHER PUBLICATIONS

IBM Technical Disclosure Bulletin, Toner Concentration Sensor Using a Polystyrene Rotating Drum, V. G. Ogredy vol. 14, No. 3 Aug. 1971.

*Primary Examiner*—James Kee Chi
*Attorney, Agent, or Firm*—Peter S. Lucyshyn

[57] ABSTRACT

An apparatus and method for sensing and controlling the concentration of toner in a developer mix comprising toner and carrier particles used to develop electrostatic images on a photoconductive or the like member includes the provision of a surface which is electrically insulated from the toner and carrier housing and is triboelectrically dissimilar from the developer mix. The developer mix is flowed over the surface and a corresponding direct current voltage is generated triboelectrically due to the interaction thereof. The direct current voltage is connected through resistance to the housing and the direct current flowing through the resistance is related to the concentration of toner in the developer mix. Apparatus responsive to a predetermined current generated is employed to control the replenishment of toner to the developer mix.

9 Claims, 3 Drawing Figures

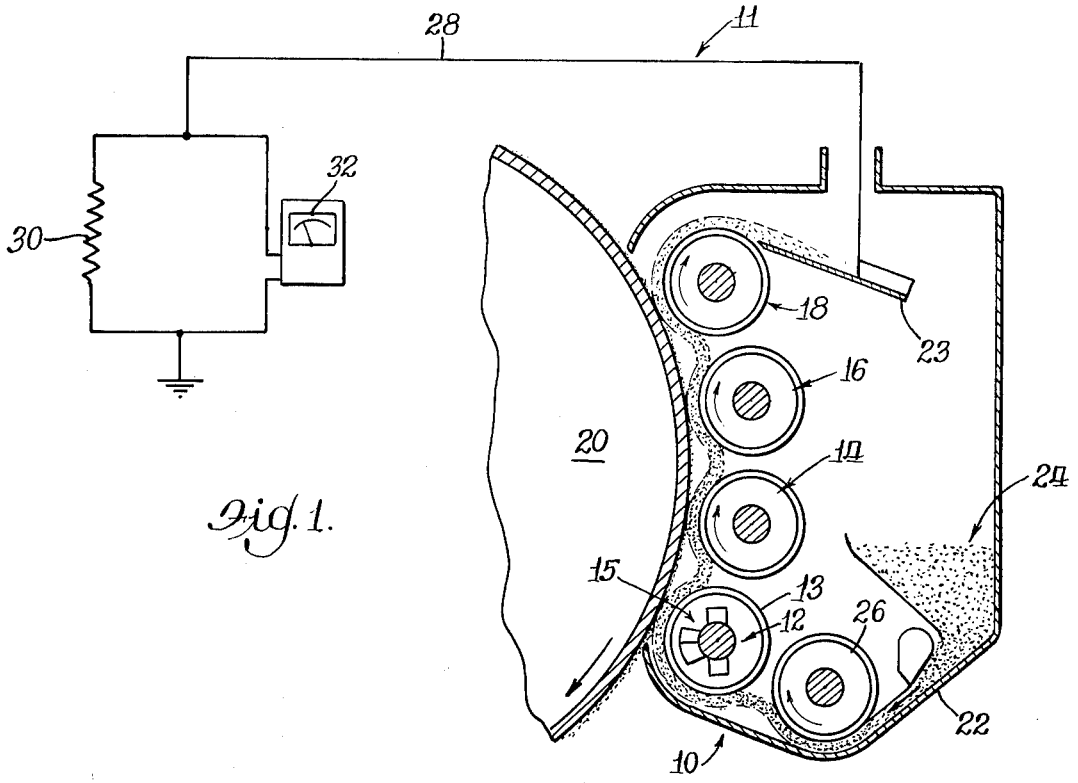
Fig. 1.
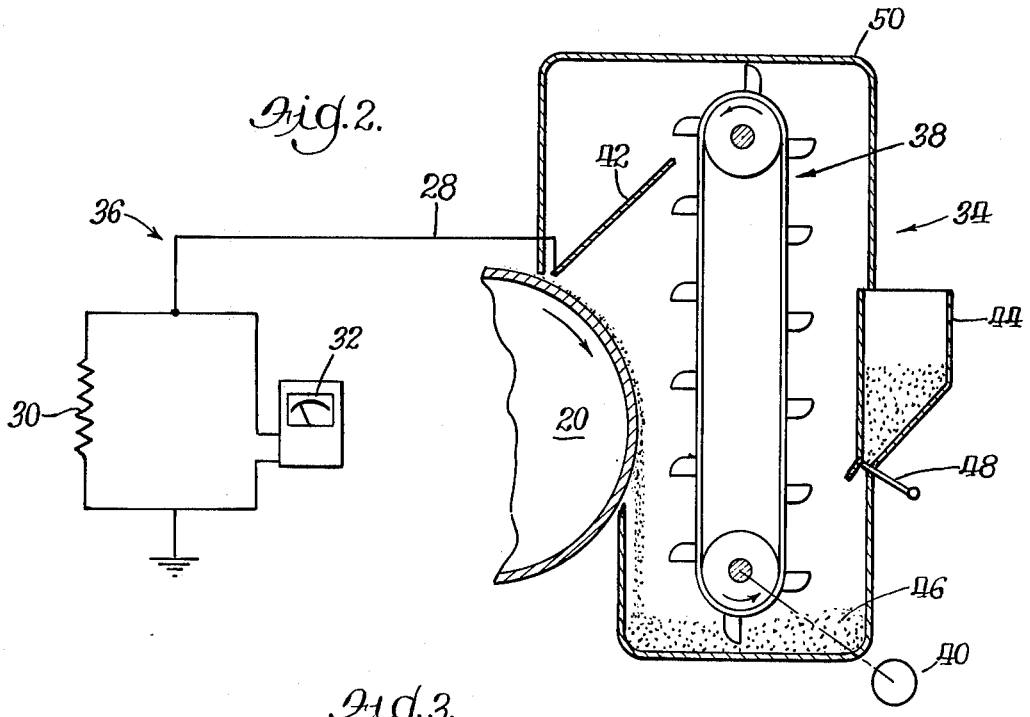
Fig. 2.
Fig. 3.
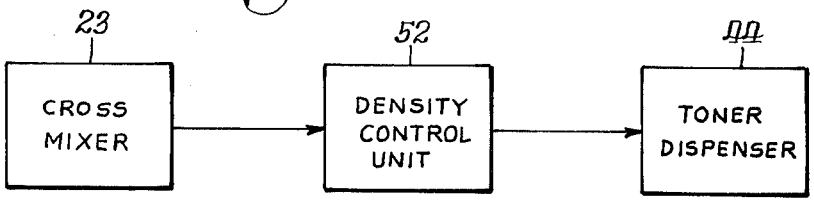

APPARATUS FOR SENSING THE CONCENTRATION OF TONER IN A DEVELOPER MIX

BACKGROUND OF THE INVENTION

This invention relates to an apparatus and method for sensing and controlling the concentration of toner in a developer mix used in a xerographic or the like copier to develop electrostatic images.

It is well known in the art that the proper concentration of toner in a developer mix comprising both toner and carrier particles used to develop latent electrostatic images produced on a photo-conductive or the like medium in a xerographic-type copier is important to the quality of the copies provided. Many different types of devices are known in the art for monitoring and controlling the toner concentration of a developer mix in a copier. One well known device uses Nesa glass over which a sample of developer mix is passed. The Nesa glass is provided with a pattern which is charged and developed by the developer mix. Light passing through the Nesa glass subsequent to development indicates the density of the toner and therefore the concentration thereof in the mix. The latter is used to control the replenishment of toner to the mix in the developer apparatus of the copier.

Other devices are also known in the art for determining the toner concentration of a developer mix. These devices employ circuitry to measure the resistance or inductance of the mix and thereby determine its toner concentration.

While the above-described devices work satisfactorily for the most part to provide an indication of the concentration of toner in a developer mix comprising both toner and carrier particles, they have certain drawbacks which make them less desirable. In the case of the first-described device, sample development with the mix is required to make the determination of toner concentration. Thus, after the glass is developed, it must be cleared of mix for the next sampling. Also, light sources and coated Nesa glass material is needed which can be expensive. In the case of the resistance or inductance measuring devices, relatively complex circuitry is required to perform the operation.

SUMMARY OF THE INVENTION

In an electrostatic copier developer of the type that employs a triboelectric mix of toner and carrier which is recirculated over a path and to which toner is to be added periodically, the present invention provides for a novel apparatus for sensing the concentration of toner. This apparatus includes a surface of material triboelectrically dissimilar from that of the mix. The surface is positioned in the flow path so that the mix flows over it. The surface is electrically isolated from the system except for an impedance coupled between it and the system ground. The flow of the dissimilar triboelectric mix over the surface generates a current from it through the impedance which current is related to the toner concentration.

DESCRIPTION OF THE DRAWING

The invention, together with further advantages and features thereof, may best be understood by reference to the following description taken in connection with the accompanying drawings, in the several figures of which like reference numerals identify like elements.

FIG. 1 and FIG. 2 are side sectional views of developer assemblies of a xerographic-type copier incorporating a toner concentration detector according to the invention;

FIG. 3 is a block diagram of a circuit for controlling the replenishment of toner to the developer mix of the developer asssemblies of FIGS. 1 and 2 in accordance with the detection of a voltage produced triboelectrically by the interaction of the developer mix and a triboelectrically dissimilar surface according to the invention.

DETAILED DESCRIPTION OF THE DRAWING

Referring now to the drawing in greater detail, there is illustrated in FIG. 1 a developer assembly 10 of a xerographic or the like copying machine which includes a toner concentration detector arrangement 11 according to the invention.

The developer assembly comprises a plurality of magnetic brush rolls 12, 14, 16 and 18 mounted about the periphery of a photoconductive drum 20 upon the surface of which latent electrostatic images are produced in a conventional manner and developed by the developer assembly 10. The developer rolls of the assembly are of the conventional type including an outer rotatably mounted insulating cylinder 13 (See roll 12) surrounding a magnet assembly 15 which produces a predetermined magnetic field at the periphery of the cylinder for picking up and transporting developer mix.

The four developer rolls of the developer assembly are mounted on a suitable frame (not shown). A housing 22 surrounding the rolls defines the developer mix sump 24 in which developer mix including toner and carrier particles is supplied to the rolls for developing the images on the drum 20. It should be noted that the toner and carrier particles comprising the developer mix are of the conventional type, the carrier being iron, ferrite, or the like particles.

A cross-mixer device 23 is provided adjacent the uppermost developer roll 18 for keeping toner and carrier intermixed as it is recirculated back to the sump 24.

In operation, developer mix in sump 24 is picked up magnetically by a fifth, "pickup" roll 26. The mix is transported magnetically to roll 12 whereat a magnetic "brush" of developer mix is formed on the surface thereof. From there the mix is transported to roll 14 whereat another brush is formed and so on to rolls 16 and 18. The brushes rub against the surface of the drum and toner is attracted to the electrostatic image thereon for development of the image.

The developer mix is carried about the surface of roll 18 as illustrated by the arrow and deposited into the cross-mixer 23. The developer mix passes through the cross-mixer, flowing over the surface thereof and from there is deposited again in sump 24.

The cross-mixer assembly is isolated electrically from the developer housing by means of an insulating layer and as such is electrically ungrounded. The cross-mixer assembly is formed of a conductive metal which is triboelectrically dissimilar from the developer mix employed in the developer assembly. It is, however, only required that the material be triboelectrically dissimilar from the developer mix. Being metal and conductive is not necessary to the operation of the apparatus according to the invention. The movement of the developer mix over the surface of the cross-mixer produces a making and breaking of contact therebetween to generate a current flow in the cross-mixer. The current is fed via conductor 28 connected to the cross-mix assembly, through a resistor 30 to ground. By ground is meant system or chasis ground, that is, the potential of the housing 22, which may be, but need not be earth ground. The flow of current through resistor 30 produces a voltage thereacross which is detectable by a suitable voltmeter such as 32, coupled as shown in FIGS. 1 and 2. The reading of the voltmeter is thus indicative of the direct current generated. Of course, this direct current is proportional to the d.c. voltage that is generated by the flow across the surface. The voltage and current through the resistance 30 generated by the interaction of the triboelectrically dissimilar developer mix and cross-mixer surface material, it can be shown, varies with the concentration of toner in the mix.

It should be noted that while in a preferred embodiment of the invention the developer mix is shown flowing over the surface of a cross-mixer of a developer assembly, the cross-mixer is used for convenience only. Any surface triboelectrically dissimilar from the developer mix and isolated electrically from ground can be employed for the purpose of tribovoltage generation.

The toner concentration detector according to the invention can be used with other types of developers as well. Referring now to FIG. 2 of the drawing, there is illustrated therein a cascade developer assembly 34 of a well-known type including a toner concentration detector arrangement 36 according to the invention. In the developer assembly developer mix is carried up by conveyor 38 which is driven by a motor 40 or other suitable drive means. The developer mix is released onto chute 42 at the top of the conveyor run, wherefrom it cascades down over the surface of the photoconductive drum 20 of the xerographic copier. Excess developer mix is recirculated into the developer mix sump 46 formed at the lower end of the outer housing 50 enclosing the assembly. The toner component of the developer mix which is used in developing a latent image on the surface of drum 20 is stored in a toner dispenser 44, and is released into the developer mix sump 46 as required. The release of the toner is controlled by gate 48.

In the developer assembly 34, chute 42 is isolated electrically from ground and is formed of a material dissimilar tribolectrically from the developer mix used in the assembly. As such, as the mix is carried by gravity over the chute 42, a current is generated to produce a triboelectric voltage detectable at volt meter 32. As in the case of the arrangement of FIG. 1, a current flows via conductor 28 and resistor 30 to ground. The volt meter 32 connected across the resistor detects the voltage produced by the current flow therethrough. This voltage or tribovoltage varies with the concentration of the toner in the developer mix.

The voltage output detected by the action of the developer mix flowing over the triboelectrically dissimilar surface can be used to control replenishment of toner to the mix as the toner concentration decreases. The latter is illustrated in FIG. 3 of the drawing wherein an automatic density control unit 52, which may include standard voltage sensing circuitry well known to one skilled in the art, is employed to control the feeding of toner from a toner hopper such as 44, shown in FIG. 2 of the drawing into the developer sump 46 when the tribovoltage value reaches a predetermined value. In this manner, a proper toner concentration in the developer mix can always be maintained.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What I claim is:

1. Apparatus for sensing the concentration of toner in a developer mix including toner and carrier particles, which is primarily housed in a housing and flows in a path therefrom and back thereto comprising: means including a surface including a material triboelectrically dissimilar from said developer mix over which said developer mix is passed in contact therewith, said surface being electrically isolated from the surrounding apparatus and coupled through an impedance to the housing, and means for sensing the value of triboelectrical current through said impedance generated by the movement of said developer mix over said surface, said current being related to the concentration of toner in said developer mix.

2. Apparatus as claimed in claim 1 further including toner replenishing means operable to add toner to said developer mix for increasing the concentration of toner therein and means coupled to said current sensing means and said toner replenishing means responsive to the sensing of a predetermined current by said sensing means for operating said toner replenishing means; and said impedance is a resistance and a direct current is generated to flow therethrough.

3. In the developer assembly of a copying machine including a developer mix sump for retaining a quantity of developer mix and developer means for transporting developer mix from said sump into contacting relation with the surface of a member carrying an electrostatic image to be developed, toner concentration detection means including in combination: surface means comprising a material being triboelectrically dissimilar from said developer mix, said surface being isolated electrically from the sump and developer means and coupled through impedance to system ground potential and being positioned in the path of said developer mix so that said mix flows thereover in contact therewith, and current sensing means coupled for sensing the current produced triboelectrically by the interaction of said developer mix and said surface, and flowing through the impedance, the value of said current being proportional to the concentration of toner in said mix.

4. A developer assembly as claimed in claim 3 wherein said surface means include a cross-mixer positioned between said developer mix transport means and said sump, said surface being at an angle to the vertical such that the mix flows across it by gravity.

5. A developer assembly as claimed in claim 4 wherein said means for transporting said developer mix from said sump to said member carrying said electrostatic image includes a magnetic brush developer having a plurality of magnetic rolls for transporting said developer mix from said sump to the surface of said member and discharging said developer mix into said cross-mixer subsequent thereto.

6. A developer assembly as claimed in claim 3 wherein said means for transporting said developer mix from said sump to said member carrying said electrostatic image includes a conveyor and chute means, said conveyor carrying said developer mix to said chute means and discharging said mix thereon, said mix flowing over said chute means onto said member for developing the image thereon.

7. A developer assembly as claimed in claim 6 wherein said surface means comprises said chute means.

8. In an electrostatic copier developer of the type that employs a recirculating triboelectric developer mix in a housing to which toner particles must be added periodically during use to maintain a desired level of toner in the mix, the improvement of a toner concentration sensing and controlling system for adding toner from a source to the mix, comprising:

a surface of material triboelectrically dissimilar from that of the mix which surface is provided in the recirculating path of the mix so that the mix flows over the surface, said surface being electrically isolated from the housing;

a resistance connecting said surface to the housing;

means for sensing the current flowing through the resistance and for selectively controlling the addition of toner from the source;

whereby the flow of mix over the surface triboelectrically generates a direct current flow through the resistance and this direct current is sensed by the sensing means to control the addition of toner from the source to the recirculating mix.

9. In an electrostatic copier apparatus of the type that employs recirculating toner to which toner material must be periodically added during use to maintain a desired level of concentration, which toner circulates in a path from a reservoir to the image to be developed and back to the reservoir, the improvement comprising:

a surface of a material which is triboelectrically dissimilar from that of the toner which surface is provided in the circulation path away from the reservoir, such that the toner makes contact with said surface and flows over said surface to generate a triboelectrically d.c. voltage on said surface which voltage is related to the concentration of the toner, said surface being electrically isolated from the remainder of the apparatus; and means for measuring the d.c. voltage being generated at said surface in response to the flow of toner thereover and for automatically controlling the addition of toner material in response to the d.c. voltage so generated.

* * * * *